US009482478B2

(12) United States Patent
Newman

(10) Patent No.: US 9,482,478 B2
(45) Date of Patent: Nov. 1, 2016

(54) NON-DETACHABLE MAGAZINE LOWER RECEIVER

(71) Applicant: Dark Storm Industries, LLC, Oakdale, NY (US)

(72) Inventor: Edward J. Newman, Bay Shore, NY (US)

(73) Assignee: Dark Storm Industries, LLC, Oakdale, NY (US)

( * ) Notice: Subject to any disclaimer, the term of this patent is extended or adjusted under 35 U.S.C. 154(b) by 0 days.

(21) Appl. No.: 14/966,671

(22) Filed: Dec. 11, 2015

(65) Prior Publication Data

US 2016/0169601 A1 Jun. 16, 2016

Related U.S. Application Data

(60) Provisional application No. 62/090,980, filed on Dec. 12, 2014.

(51) Int. Cl.

| | |
|---|---|
| ***F41A 17/38*** | (2006.01) |
| ***F41A 3/66*** | (2006.01) |
| ***F41A 21/02*** | (2006.01) |
| ***F41C 23/00*** | (2006.01) |
| ***F41A 9/61*** | (2006.01) |

(52) U.S. Cl.
CPC .. *F41A 3/66* (2013.01); *F41A 9/61* (2013.01); *F41A 21/02* (2013.01); *F41C 23/00* (2013.01)

(58) Field of Classification Search
CPC ..... F41A 3/64; F41A 3/66; F41A 9/52; F41A 9/61; F41A 9/12; F41A 9/15; F41A 17/38; F41A 21/02; F41C 23/20
USPC ..... 42/6, 49.02
See application file for complete search history.

(56) References Cited

U.S. PATENT DOCUMENTS

| | | | | |
|---|---|---|---|---|
| 1,900,818 | A * | 3/1933 | Jager | F41A 3/16 42/17 |
| 2,875,544 | A * | 3/1959 | Krieger | F41A 9/59 42/18 |
| 2,900,877 | A * | 8/1959 | McClenahan | F41A 3/46 42/16 |
| 4,314,419 | A * | 2/1982 | Koon, Jr. | F41A 9/65 42/50 |
| D329,078 | S | 9/1992 | Hasselbush | |
| 5,899,013 | A * | 5/1999 | Hauser | F41A 17/38 42/6 |
| 6,739,082 | B2 * | 5/2004 | Christensen | F41A 9/70 42/49.02 |
| 7,398,616 | B1 * | 7/2008 | Weir | F41C 23/04 42/71.01 |
| D600,771 | S | 9/2009 | Fitzpatrick et al. | |

(Continued)

OTHER PUBLICATIONS

ComGraf LLC Products, CT Legal ARS, http://www.ctlegalars.com/#!products/c15uw, last visited Feb. 25, 2016.

*Primary Examiner* — Bret Hayes
*Assistant Examiner* — Derrick Morgan
(74) *Attorney, Agent, or Firm* — Carter, DeLuca, Farrell & Schmidt, LLP

(57) ABSTRACT

A non-detachable magazine lower receiver for a firearm includes a stock mount, a trigger well extending from the stock mount, and a magazine well. The trigger well is configured to receive a firing mechanism. The magazine well is configured to receive a magazine. A proximal wall of the magazine defines a retention opening that passes through a distal wall of the trigger well. The retention opening is configured to receive a magazine retention member for fixing a magazine recovered in the magazine well to the lower receiver.

13 Claims, 12 Drawing Sheets

(56) References Cited

U.S. PATENT DOCUMENTS

D603,011 S 10/2009 Fitzpatrick et al.
8,756,845 B2 6/2014 Harris et al.
D713,485 S * 9/2014 Firpo, I ..... D22/108
9,010,004 B1 * 4/2015 Fu ..... F41A 17/38 42/49.01
9,182,186 B1 * 11/2015 Prince ..... F41A 17/38
2004/0020092 A1 * 2/2004 Christensen ..... F41A 9/70 42/49.01
2006/0123683 A1 * 6/2006 Garrett ..... F41A 17/38 42/6
2011/0056107 A1 * 3/2011 Underwood ..... F41A 9/59 42/18
2011/0099874 A1 * 5/2011 Zedrosser ..... F41A 3/66 42/73
2011/0277365 A1 11/2011 Barletta
2012/0180354 A1 * 7/2012 Sullivan ..... F41A 3/26 42/16
2013/0227869 A1 9/2013 Thordsen
2014/0033589 A1 * 2/2014 King, Jr. ..... F41A 3/66 42/75.01
2014/0223790 A1 8/2014 Wilson
2014/0230297 A1 * 8/2014 Larson, Jr. ..... F41A 17/38 42/6
2014/0260943 A1 * 9/2014 Alis ..... F41A 3/54 89/154
2014/0317980 A1 * 10/2014 Michel ..... F41A 3/66 42/6
2014/0331535 A1 * 11/2014 Robinson ..... F41A 3/66 42/6
2015/0052793 A1 * 2/2015 Cassady ..... F41A 9/61 42/8
2015/0082678 A1 * 3/2015 Jacobson ..... F41A 9/65 42/8
2015/0198395 A1 * 7/2015 Visinski ..... F41A 3/66 42/6
2015/0338180 A1 * 11/2015 Noro ..... F41A 17/38 42/6
2015/0345885 A1 * 12/2015 Brown ..... F41A 17/38 42/6
2016/0033218 A1 * 2/2016 Folkestad, II ..... F41A 3/66 89/194
2016/0069628 A1 * 3/2016 Fluhr ..... F41A 17/38 42/6
2016/0076840 A1 * 3/2016 Leimer ..... F41A 9/64 42/50
2016/0116250 A1 * 4/2016 Mather ..... F41A 3/66 42/73
2016/0116251 A1 * 4/2016 Mather ..... F41A 21/482 42/71.01

* cited by examiner

NON-DETACHABLE MAGAZINE LOWER RECEIVER

CROSS-REFERENCE TO RELATED APPLICATION

This application claims the benefit of, and priority to, U.S. Provisional Patent Application Ser. No. 62/090,980, filed Dec. 12, 2014, the entire contents of which is hereby incorporated by reference.

BACKGROUND

1. Technical Field

The present disclosure relates to firearms and, more specifically, to non-detachable magazine lower receivers for firearms.

2. Discussion of Related Art

Semi-automatic firearms, particularly those with detachable magazines, are coming under heightened regulation and restriction. A "detachable magazine" is generally defined as an ammunition feeding device that can be removed from a firearm without disassembly of the firearm action.

Standard semi-automatic firearms are manufactured and sold with a detachable magazine. Users can replace a magazine in the standard semi-automatic firearms without disassembling the firearm action. Such semi-automatic firearms are likely to face increased restriction and regulation.

In an effort to comply with the heightened regulations there is a need to develop semi-automatic firearms with non-detachable magazines. A "non-detachable magazine" is generally defined as an ammunition feeding device that is formed as an integral part of the firearm or is otherwise made fixed to the firearm in such a manner that it cannot be removed without disassembly of the firearm.

SUMMARY

This disclosure relates generally to a lower receiver that includes a non-detachable magazine. The lower receiver defines an internally disposed retention opening that is not accessible without disassembly of the lower receiver. The retention opening is configured and dimensioned to receive a magazine retention member. Accordingly, the presently disclosed lower receiver prevents magazines from being swapped without disassembly of the lower receiver. In some embodiments, the stock and/or the firing mechanism must be removed from the lower receiver to allow access to the magazine retention member.

In an aspect of the present disclosure, a lower receiver for a firearm includes a body that defines a trigger well and a magazine well. The body includes a wall that separates the magazine well from the trigger well. The wall defines a retention opening that passes between the magazine well and the trigger well. The trigger well is configured and dimensioned to receive a firing mechanism and the magazine well is configured and dimensioned to receive a magazine. The retention opening is configured and dimensioned to receive a magazine retention member that fixes a magazine within the magazine well.

In aspects, the lower receiver includes a mount disposed at a proximal portion of the trigger well. The mount may define a tool passage that is aligned with the retention opening. The mount may be configured to secure a stock to the lower receiver such that the stock covers the tool passage.

In some aspects, the lower receiver includes a firing mechanism that is disposed within the trigger well. The firing mechanism may be configured to prevent access to a magazine retention member when disposed in the retention opening.

In another aspect of the present disclosure, a firearm includes a stock, an upper receiver, a barrel, a lower receiver, a magazine, and a magazine retention member. The upper receiver defines a chamber and the barrel extends distally from the upper receiver. The lower receiver is pivotally coupled to the upper receiver and includes a body and a mount. The body defines a trigger well configured and dimensioned to receive a firing mechanism and a magazine well that extends from the trigger well. The body includes a wall that separates the magazine well from the trigger well. The wall defines a retention opening that passes between the trigger well and the magazine well. The mount is positioned on a proximal wall that defines the trigger well. The stock is secured to the mount. The magazine is disposed within the magazine well of the lower receiver. A proximal wall of the magazine defines a retention hole. The magazine retention member extends through the retention opening and the retention hole to fix the magazine within the magazine well of the lower receiver.

In aspects, the retention hole of the magazine is threaded and the magazine retention member is a screw that is threadable into the retention hole. Additionally or alternatively, the retention opening of the lower receiver may be threaded and the magazine retention member may be threadable into the retention opening.

In some aspects, the firearm includes a firing mechanism that is disposed within the trigger well of the lower receiver. The firing mechanism may be configured and dimensioned to prevent access to the magazine retention member.

In particular aspects, the mount defines a tool passage that is aligned with the retention opening. The tool passage may be configured to allow a tool to access the magazine retention member that is disposed within the retention opening. The firearm may include a firing mechanism that is disposed between the tool passage and the retention opening to prevent access to the magazine retention member when the firing mechanism is installed within the lower receiver. The stock may cover the tool passage when the stock is attached to the lower receiver.

In another aspect of the present disclosure, a lower receiver for a firearm includes a body that defines a trigger well and a magazine well. The trigger well is configured and dimensioned to receive a firing mechanism. The magazine well extends from the trigger well and is configured and dimensioned to receive a magazine. A proximal wall that defines the magazine well and a distal wall defining the trigger well cooperate to define a retention opening that passes between the magazine well and the trigger well. The retention opening is configured and dimensioned to receive a magazine retention member that fixes a magazine to the lower receiver.

In aspects, the lower receiver includes a firing mechanism disposed within the trigger well that is configured and dimensioned to prevent access to a magazine retention member disposed within the retention member. The lower receiver may include a stock mount that is configured and dimensioned to attach a stock to the lower receiver. The stock mount may define a tool passage that is aligned with the retention opening. The tool passage may be configured to permit passage of a tool and is positioned to be covered when a stock is attached to the lower receiver.

In another aspect of the present disclosure, a method for assembling a lower receiver includes sliding a magazine into a magazine well defined in the lower receiver, aligning a retention hole defined in the magazine with a retention opening defined in a proximal wall of the magazine well, and inserting a magazine retention member through the retention opening of the magazine well and the retention hole of the magazine to fix the magazine within the magazine well.

In aspects, the method includes installing a firing mechanism into the trigger well defined in the lower receiver proximal to the magazine well. The firing mechanism may prevent access to the magazine retention member when installed in the trigger well. The method may include attaching a stock to a stock mount of the lower receiver. The stock may prevent access to the magazine retention member when the stock is attached to the stock mount.

Further, to the extent consistent, any of the aspects described herein may be used in conjunction with any or all of the other aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
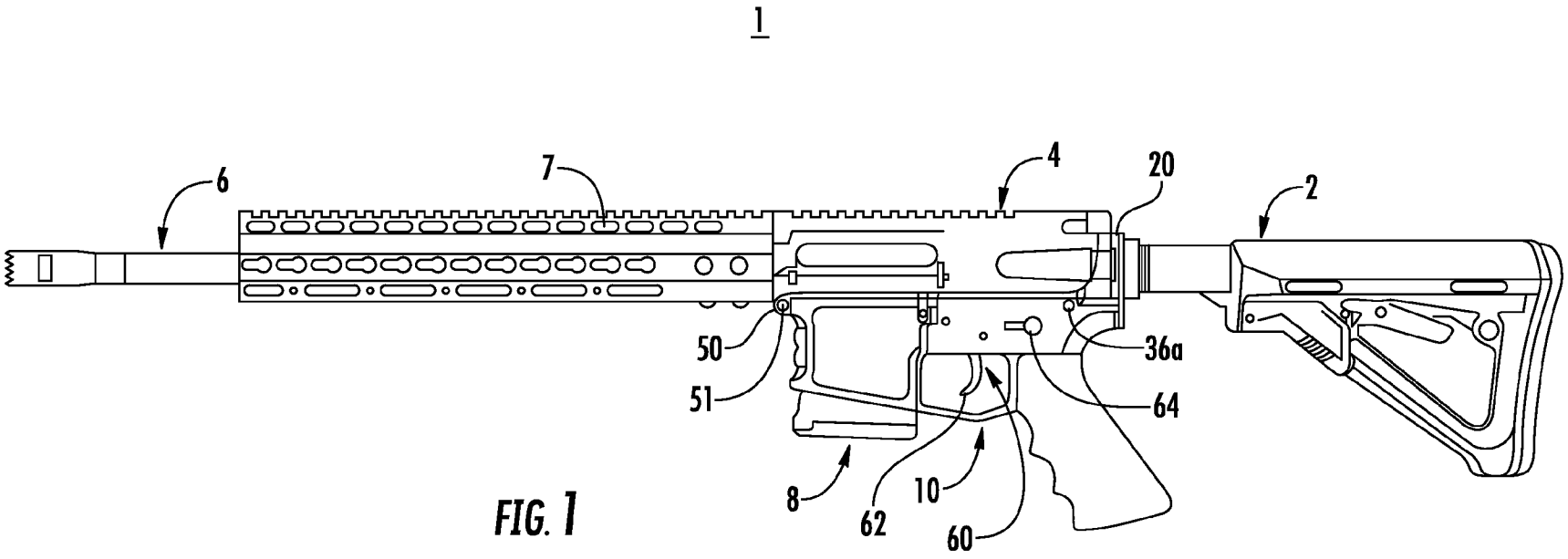
FIG. 1 is a left side view of a firearm including a lower receiver provided in accordance with the present disclosure.

Embodiments of the present disclosure are now described in detail with reference to the drawings in which like reference numerals designate identical or corresponding elements in each of the several views. Throughout this description, the term "proximal" refers to the portion of the device or component thereof that is closest to a user and the term "distal" refers to the portion of the device or component thereof that is farthest from the user.

This disclosure relates to lower receivers for firearms including a non-detachable magazine. The lower receivers of the present disclosure define a retention opening to receive an internally disposed magazine retention member, for example, a screw that fixes a magazine within the lower receiver. An upper receiver is pivotally attached to the lower receiver about a receiver coupling, which is disposed at a distal end of the lower receiver to permit reloading of the magazine fixed within the lower receiver. As detailed below, the magazine retention member is removable from the lower receiver only when the stock is first disassembled from the lower receiver. In addition, removal of the magazine retention member may require the firing mechanism to be removed or disassembled from the lower receiver.

Referring now to FIG. 1, a firearm 1 is shown, which includes a buffer or stock 2, an upper receiver 4, a barrel 6, a magazine 8, and a lower receiver 10 in accordance with the present disclosure. The stock 2 is attached to a stock mount 20 positioned at the proximal end of the lower receiver 10. The stock 2 may be a fixed stock, an adjustable stock, a collapsible stock, an arm brace, or a buffer tube 102 (FIG. 12) without a stock or arm brace. The upper receiver 4 is pivotally coupled to the lower receiver 10 at a receiver coupling 50 positioned at the distal end of the lower receiver 10. The receiver coupling 50 receives a pivot pin 51 that pivotally couples the lower receiver 10 to the upper receiver 4. The barrel 6 extends from the upper receiver 4. The firearm 1 may also include a rail system 7 disposed about the barrel 6 to facilitate the mounting of accessories to the firearm 1.

Figure 2:
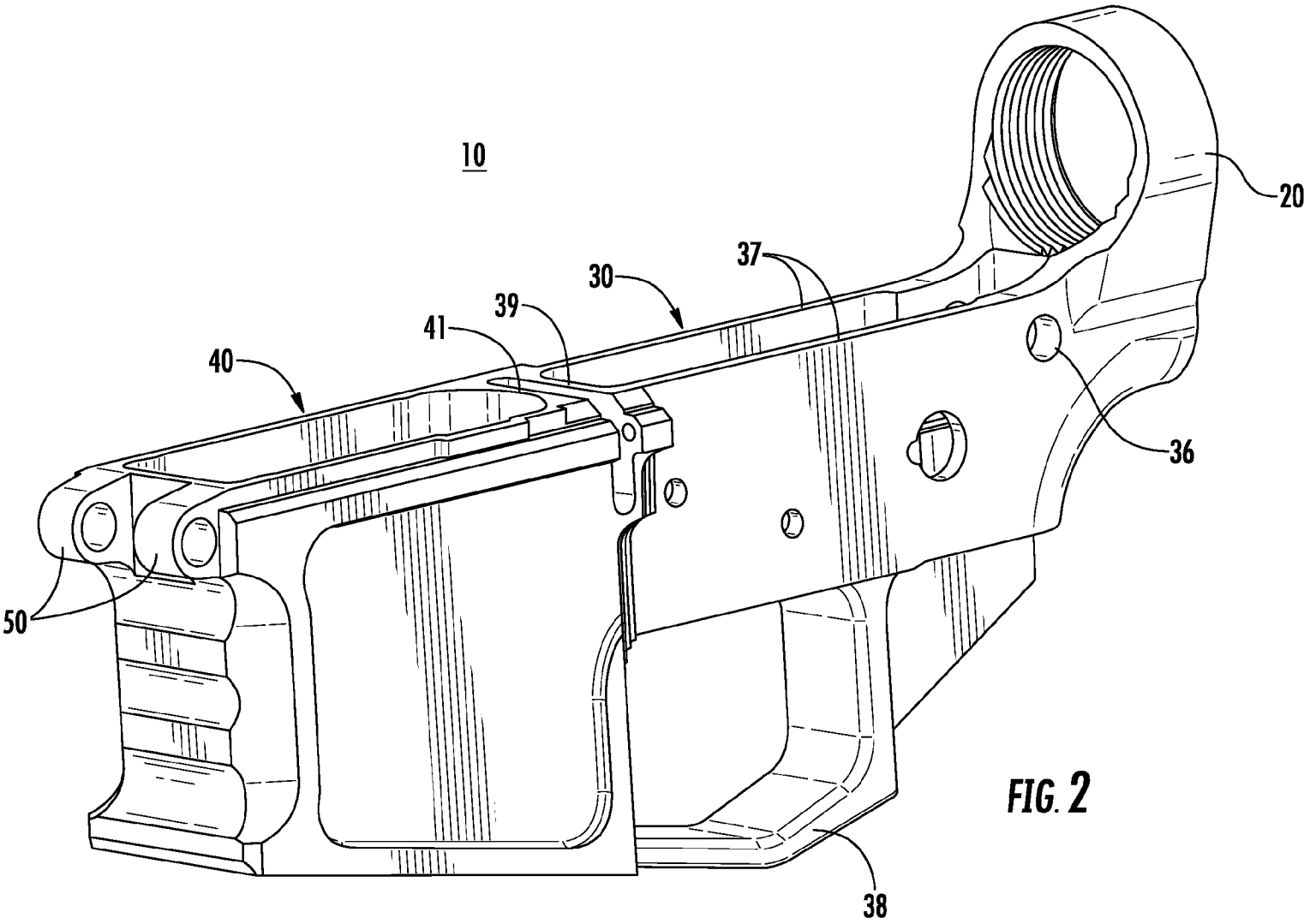
FIG. 2 is a front left side perspective view of the lower receiver of FIG. 1.
Figure 3:
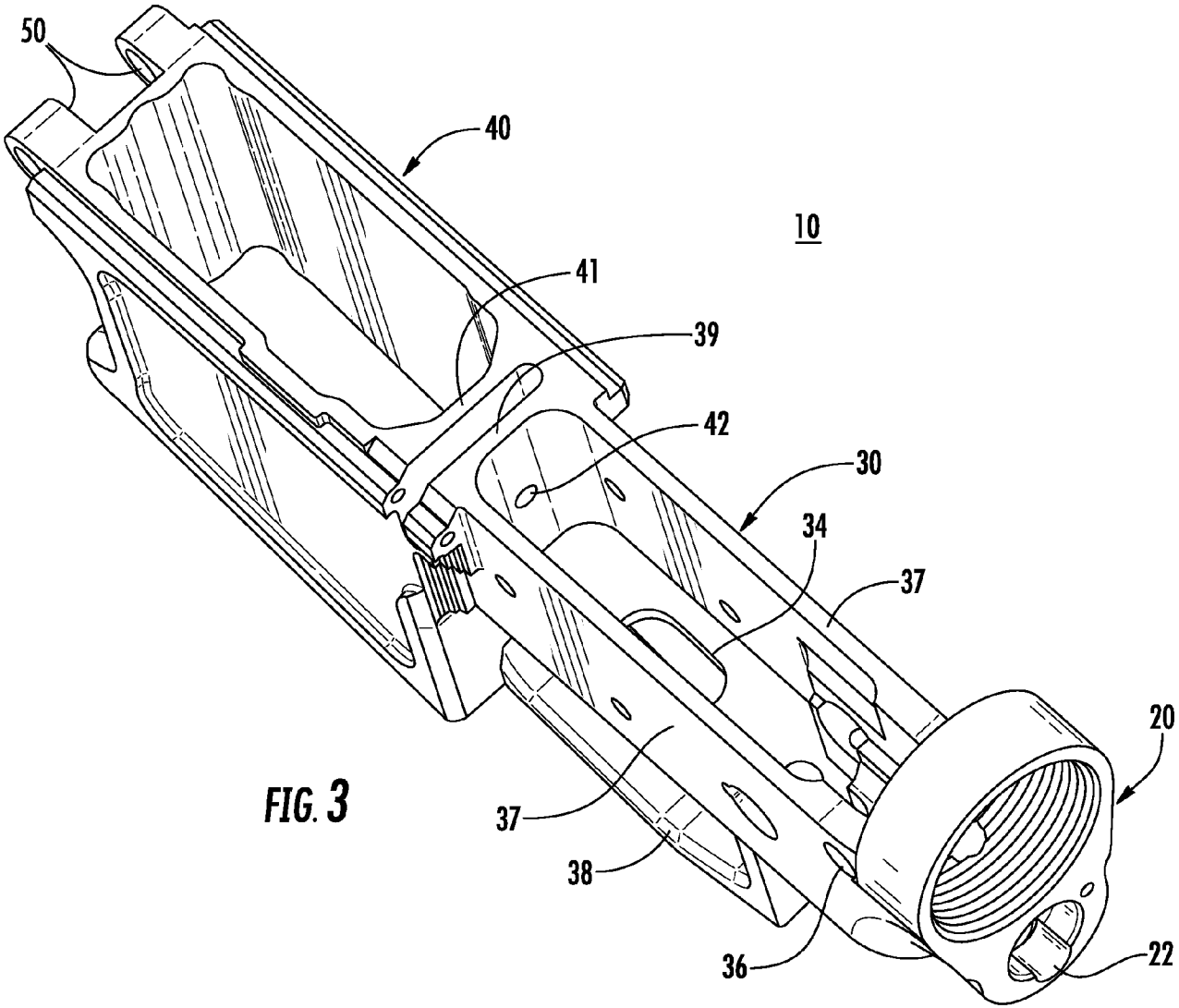
FIG. 3 is a top-rear perspective view of the lower receiver of FIG. 2.
Figure 4:
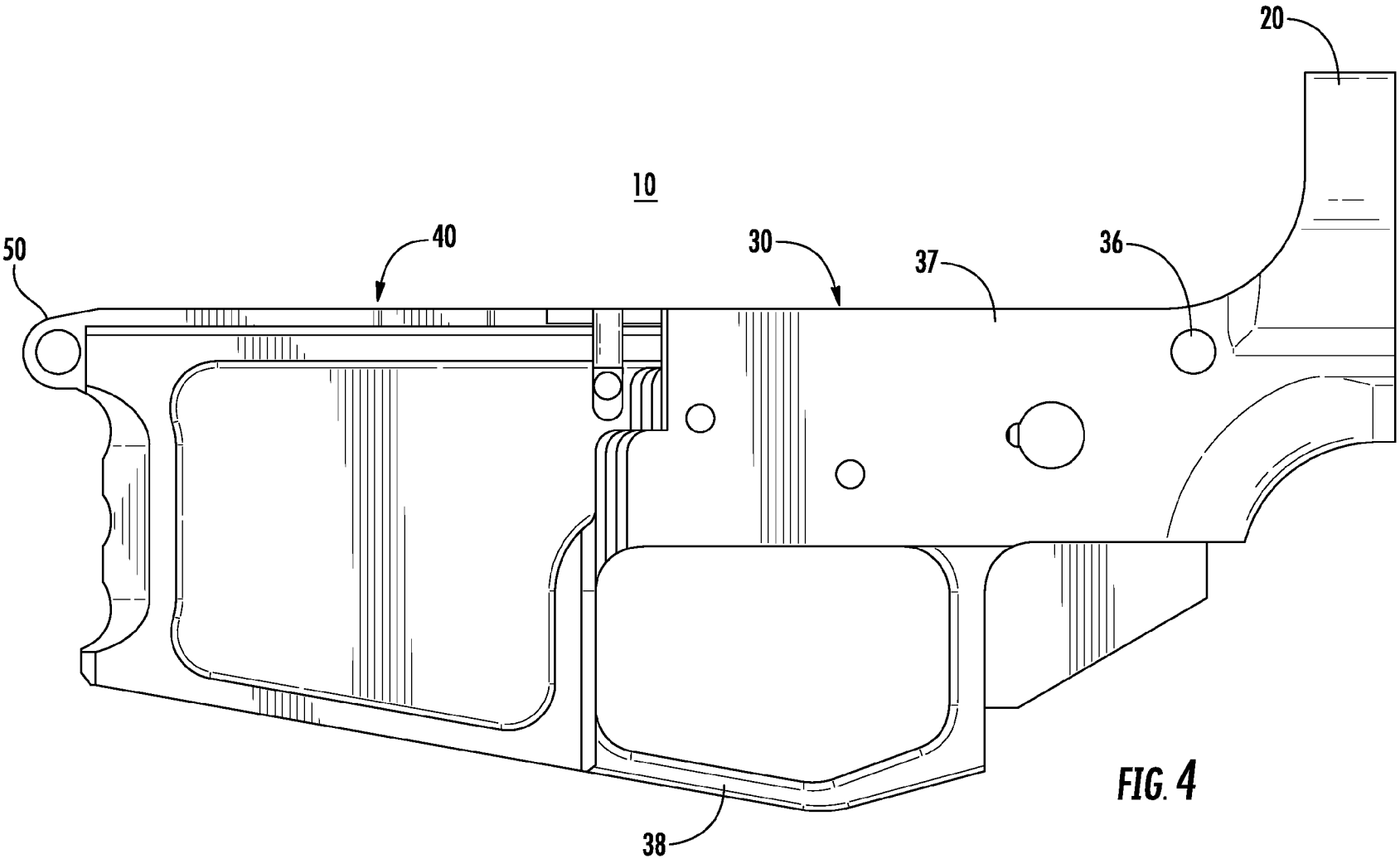
FIG. 4 is a left side view of the lower receiver of FIG. 2.
Figure 5:
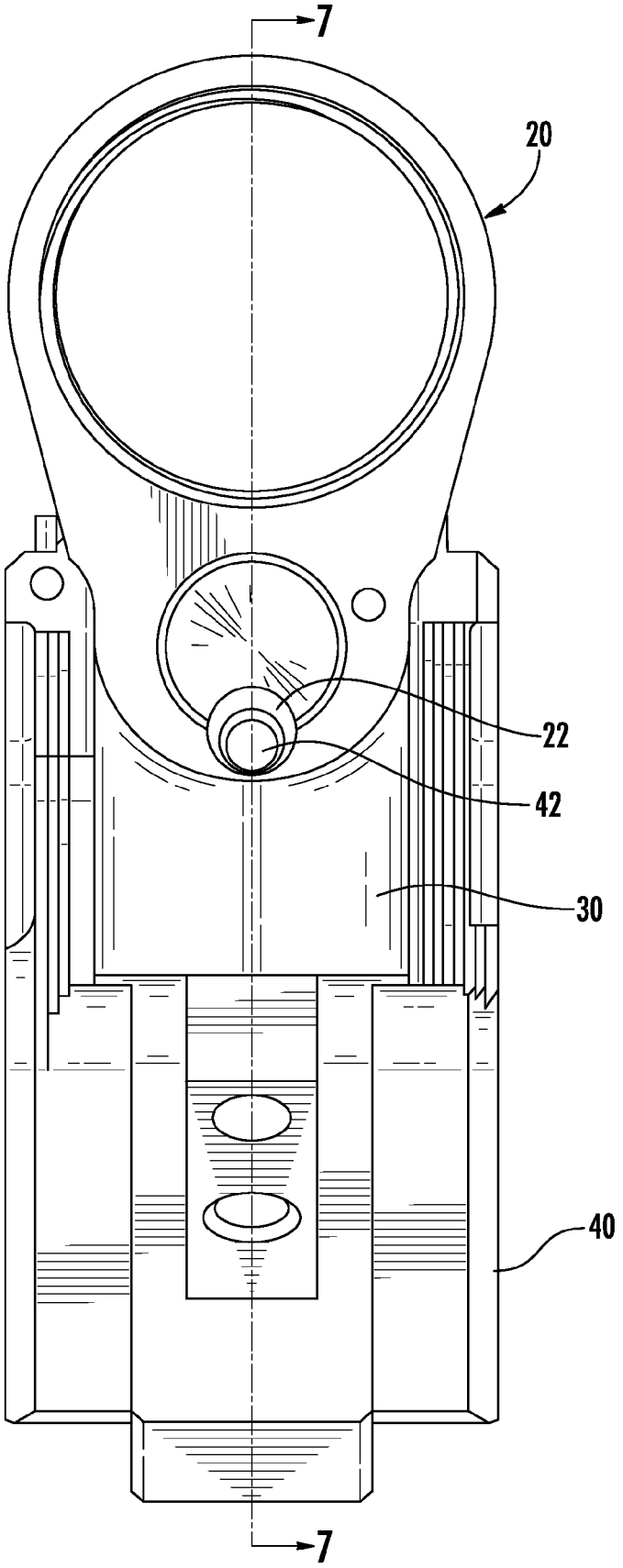
FIG. 5 is a rear view of the lower receiver of FIG. 2.
Figure 6:
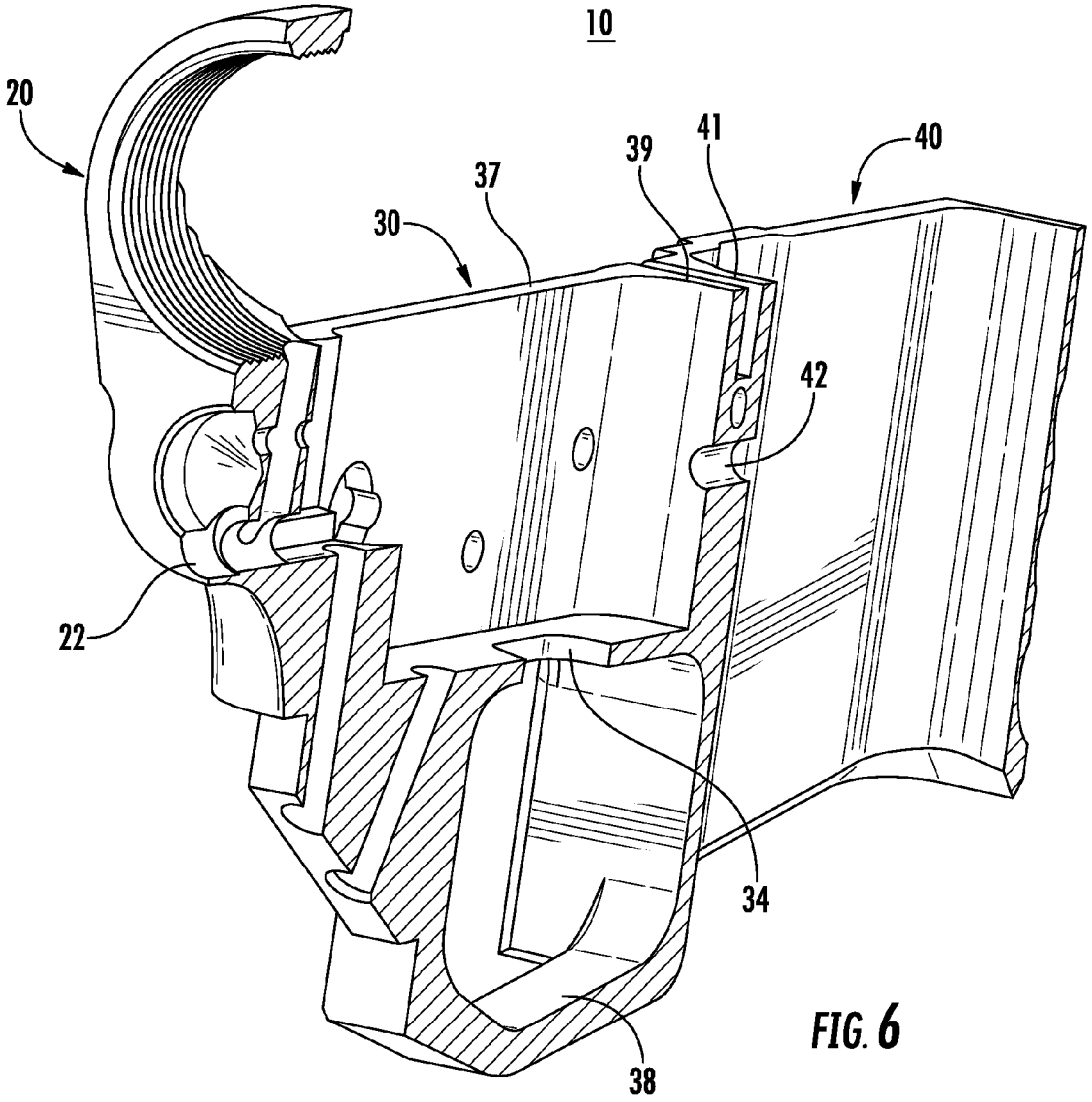
FIG. 6 is a cut-away view of the lower receiver of FIG. 3.
Figure 7:
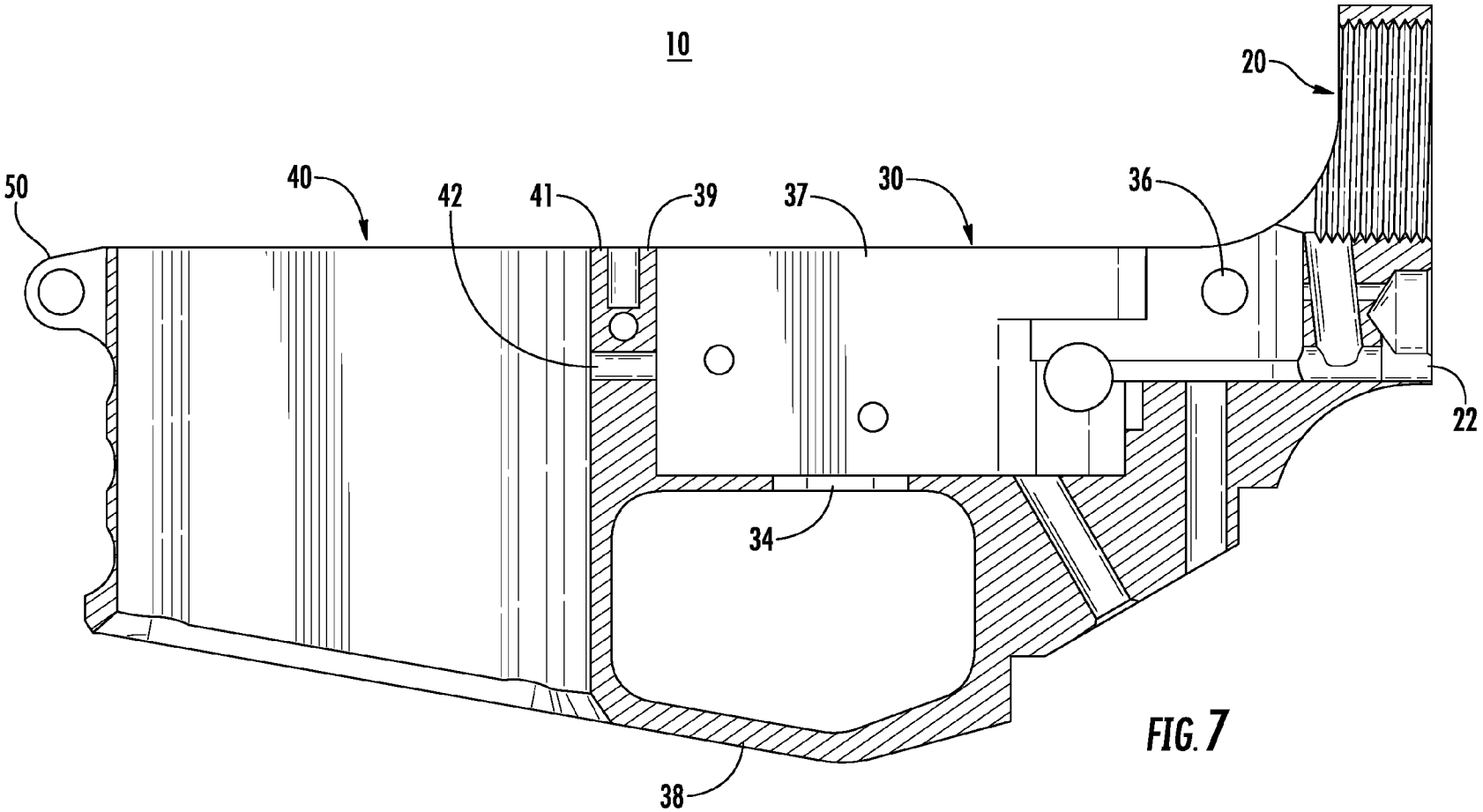
FIG. 7 is a cross-sectional view taken along section line 7-7 of FIG. 5.
Figure 8:
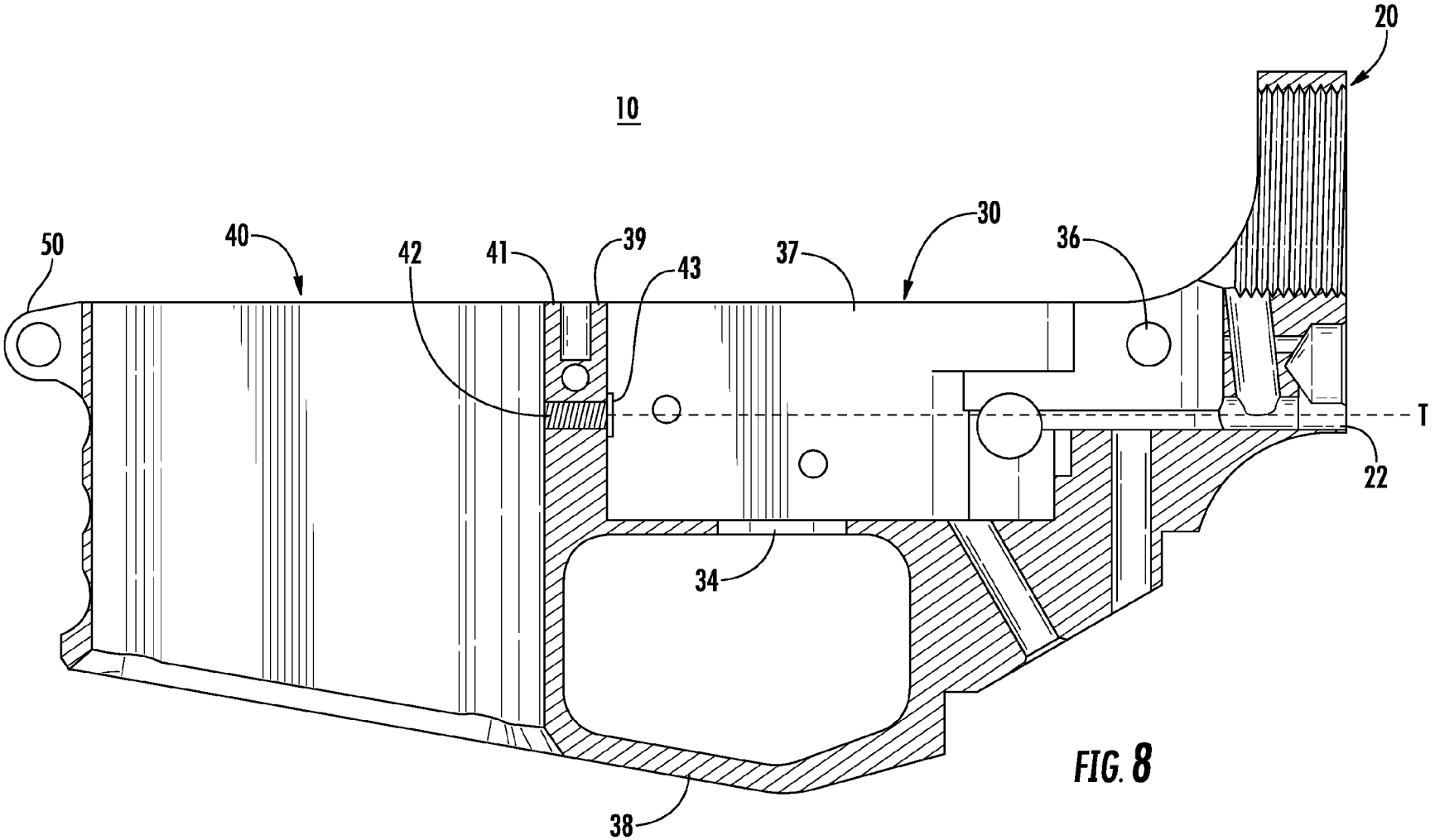
FIG. 8 is the cross-sectional view of FIG. 7 with an illustrative example of a magazine retention member installed.

Referring now to FIGS. 2-4, the lower receiver 10 includes the stock mount 20, a trigger well 30, a magazine well 40, and the receiver coupling 50. The trigger well 30 is positioned adjacent the stock mount 20 and the magazine well 40 is positioned adjacent the receiver coupling 50 such that the trigger well 30 is positioned between the magazine well 40 and the stock mount 20 and the magazine well 40 is positioned between the trigger well 30 and the receiver coupling 50. The trigger well 30 is configured to receive a firing mechanism 60 that includes a trigger 62 and safety/fire selector 64.

A trigger guard 38 extends from a lower surface of the trigger well 30 and connects to a proximal surface of the magazine well 40. The trigger guard 38 may be integrally formed with lower receiver 10 or may be removable from the lower receiver 10. The trigger 62 passes through a trigger opening 34 that is defined in a lower portion of the trigger well 30 and is positioned above the trigger guard 38 such that a user may engage the trigger 62 to actuate the firing mechanism 60. The trigger well 30 also defines a lock opening 36 that passes through sidewalls 37 of the trigger well 30. The lock opening 36 receives a locking pin **36*a* (FIG. 1) that selectively fixes the upper receiver 4 to the lower receiver 10**.

Referring to FIGS. 5-8, the stock mount 20 defines a tool passage 22 that is aligned with a retention opening 42. The tool passage 22 is covered when a stock is attached to the stock mount 20.

Figure 9:
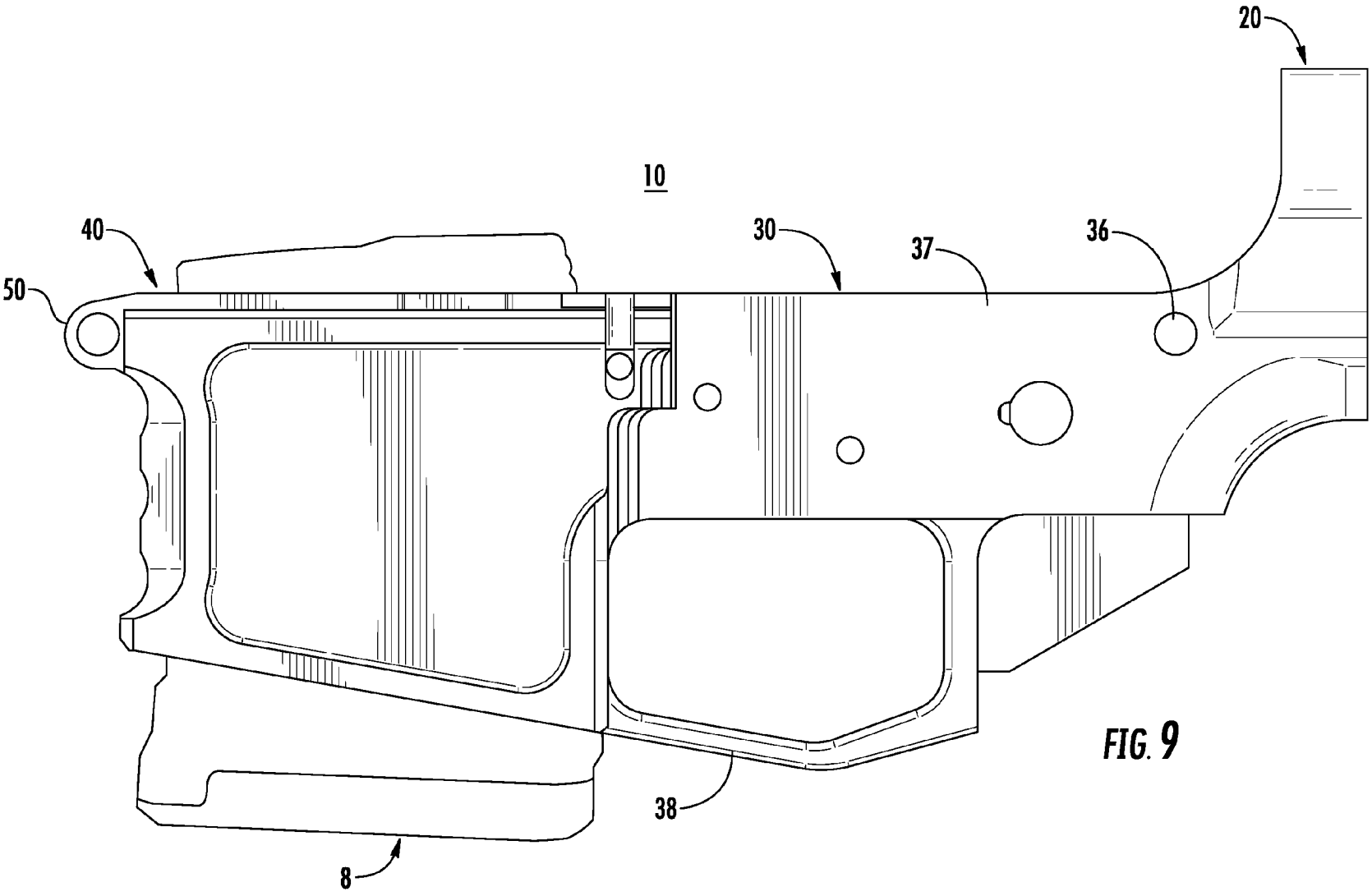
FIG. 9 is a left side view of the lower receiver of FIG. 2 with a magazine installed.

The magazine well 40 is configured to receive the magazine 8 (FIG. 1) and to fix the magazine 8 to the lower receiver 10. The magazine well 40 defines the retention opening 42 that passes through a proximal wall 41 of the magazine well 40 and a distal wall 39 of the trigger well 30. The retention opening 42 is threaded and is configured to receive a magazine retention member, such as for example, a magazine retention screw 43 (FIG. 8) that engages a magazine (e.g., magazine 8 FIG. 1) received within the magazine well 40 to fix the magazine within the lower receiver 10. The magazine retention screw 43 engages a retention hole 9 (FIG. 11) that is machined into a magazine 8. With the magazine retention screw 43 received within the retention opening 42, the magazine is fixed within the magazine well 40 of the lower receiver 10 as shown in FIG. 9.

Alternatively, the magazine retention screw 43 may engage a portion of the magazine 8 that is traditionally engaged by a magazine release mechanism (not shown) of a standard semi-automatic firearms which allows standard magazines to be fixed within the lower receiver 10.

The tool passage 22 allows a tool (not shown) to pass through the trigger well 30 and to engage the magazine retention screw 43 for removal the magazine retention screw 43 as represented by the dashed line T. The tool may be a standard screwdriver or may be a driver with a specialty tip that is configured to engage a head of the magazine retention screw 43. With the magazine retention screw 43 removed, a magazine is removable from the magazine well 40 for maintenance or replacement. It will be appreciated that the tool may only pass through the tool passage 22 when a stock (e.g., stock 2 (FIG. 1)) is detached or disassembled from the lower receiver 10. The firing mechanism 60 may also need to be removed or disassembled from the trigger well 30 to allow the tool to engage the magazine retention screw 43.

As detailed above, the locking pin 36*a* (FIG. 1) selectively fixes the upper receiver 4 to the lower receiver 10. When the locking pin 36*a* is in a locked position, the upper receiver is fixed to the lower receiver 10 as shown in FIG. 1 such that a cartridge 68 (FIG. 10) may pass from the magazine 8 fixed in the magazine well 40 of the lower receiver 10 into a chamber (not shown) of the upper receiver 4. The trigger 62 (FIG. 1) of the firing mechanism 60 is then engaged by a user to fire the cartridge 68 from the chamber of the upper receiver 4, to eject the fired cartridge 68 from the chamber, and to load a subsequent cartridge 68 from the magazine 8 into the chamber. This process may be repeated until the magazine is empty (i.e., out of cartridges).

Figure 10:
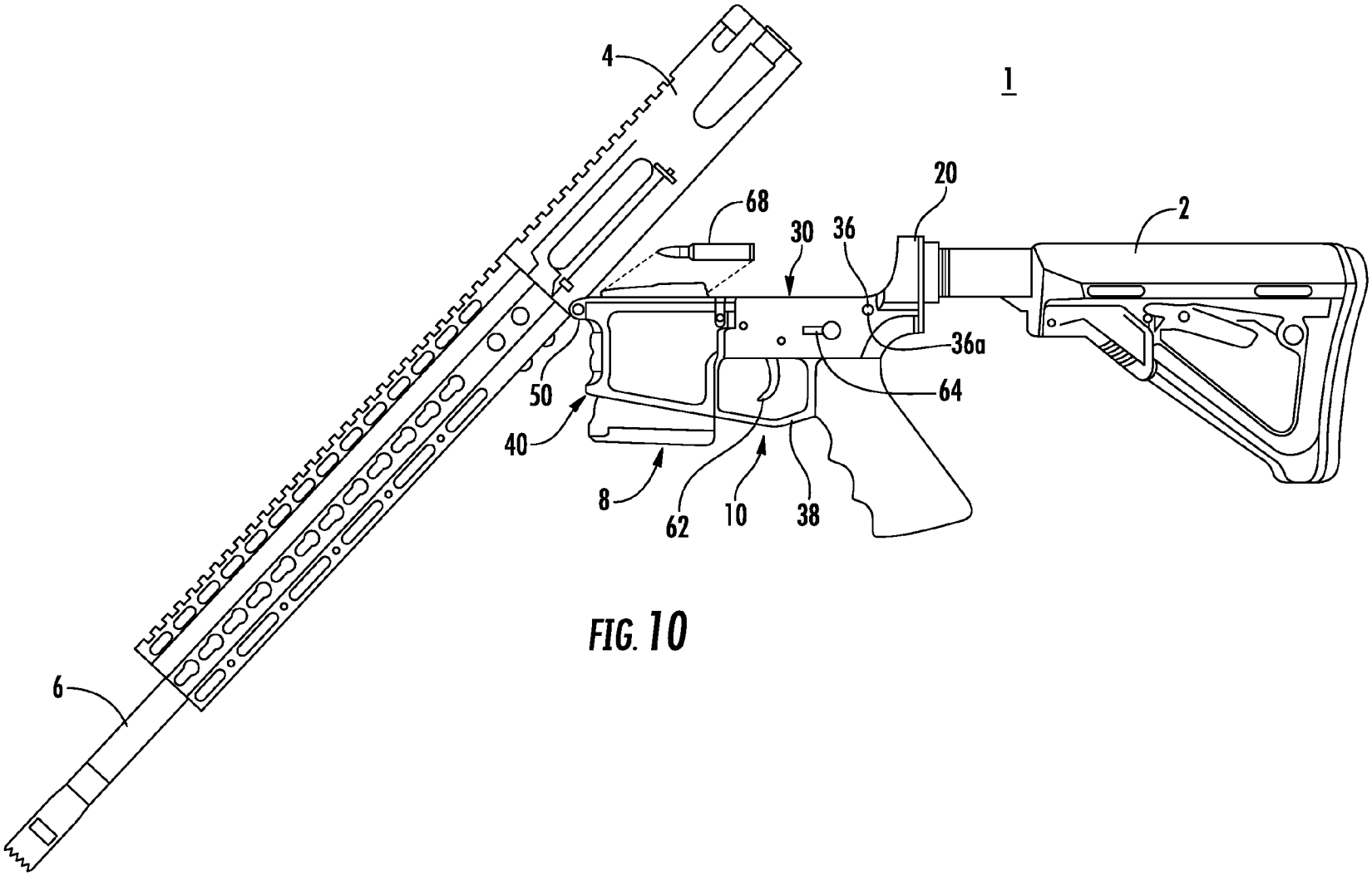
FIG. 10 is a left side view of the firearm of FIG. 1 with the upper receiver pivoted relative to the lower receiver in a loading position.

Referring to FIG. 10, the magazine 8 may be reloaded with fresh cartridges 68 or unloaded by moving the locking pin 36*a* to an unlocked position and pivoting the upper receiver 4 to a loading position relative to the lower receiver 10 about the pivot coupling 50. When the upper receiver 4 is pivoted in the loading position, the upper portion of the magazine well 40 is accessible to load cartridges 68 or to remove cartridges 68 from the magazine 8. It will be appreciated that the magazine 8 is fixed within the magazine well 40 of the lower receiver 10 by the magazine retention screw 43 (FIG. 9).

Figure 11:
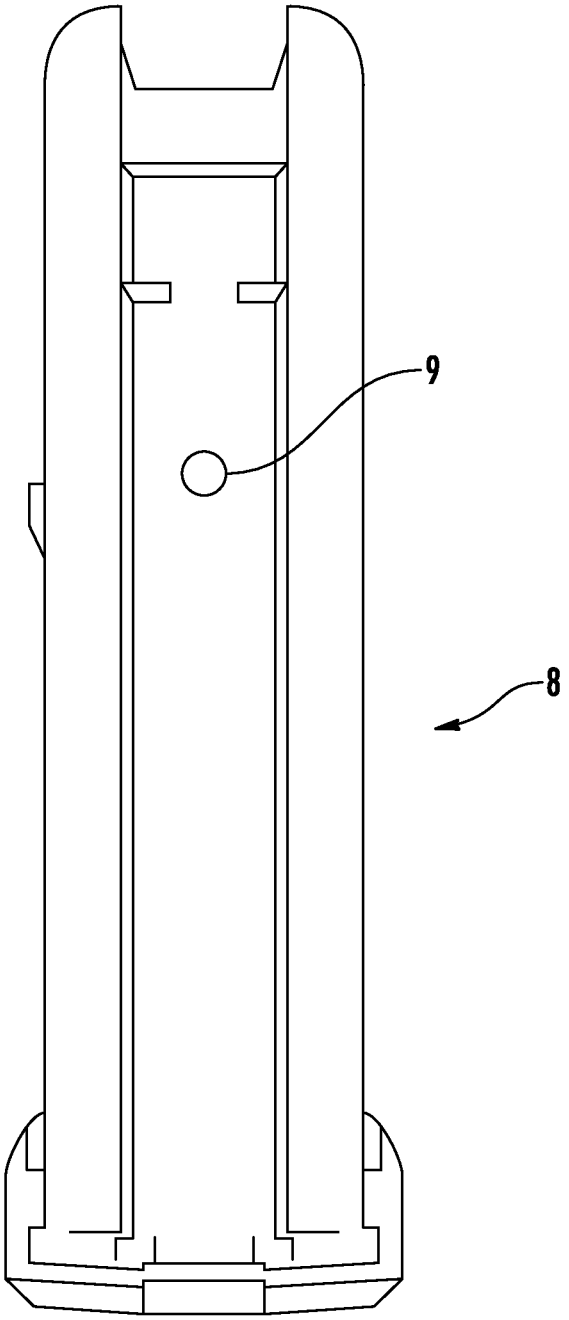
FIG. 11 is a rear view of the magazine of FIG. 9.

Referring now to FIG. 11, the magazine 8 includes a retention hole 9 formed therein that aligns with the retention opening 42 when the magazine is fully received within the magazine well 40 of the lower receiver 10. When the hole 9 is aligned with the retention opening 42, the magazine retention screw 43 is threaded through the retention opening 42 and the retention hole 9 to secure the magazine 8 within the magazine well 40.

Figure 12:
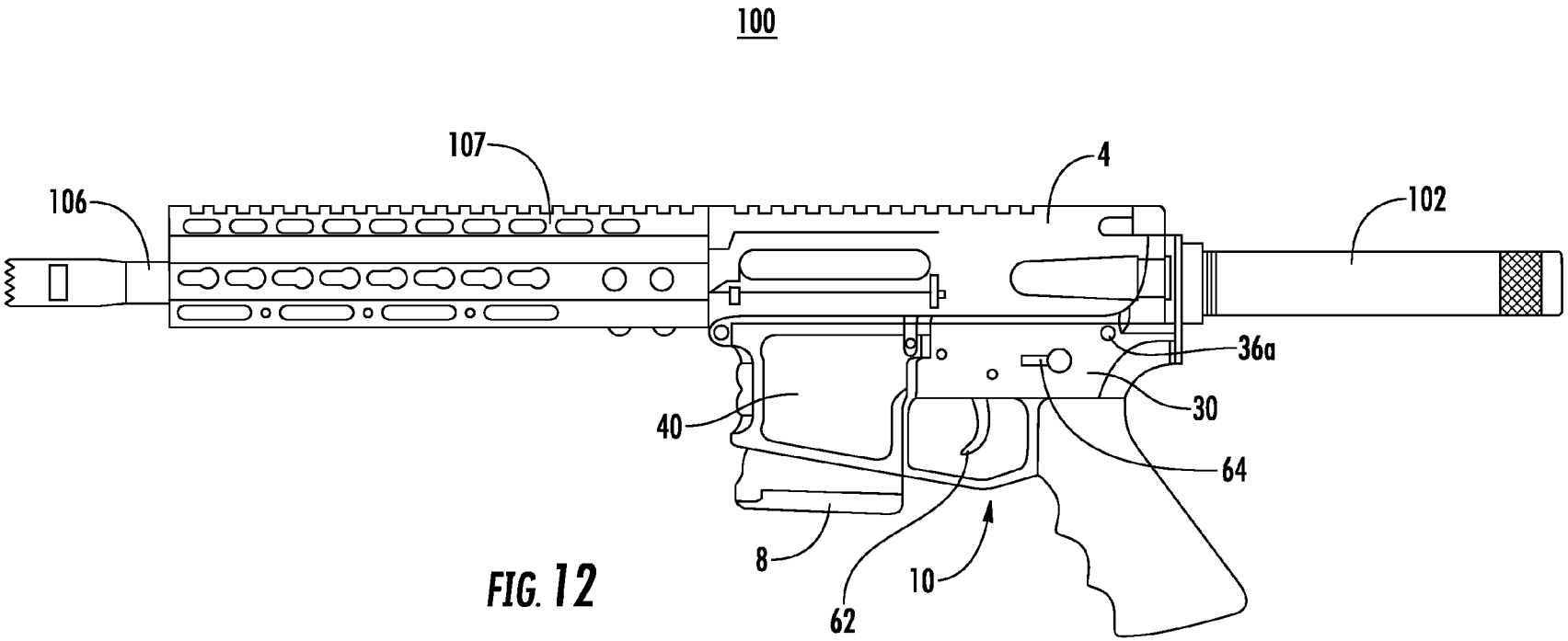
FIG. 12 is a side view of an illustrative semi-automatic pistol embodiment provided in accordance with the present disclosure.

With reference to FIG. 12, the lower receiver 10 may also be used with a semi-automatic pistol 100. The pistol 100 includes a buffer tube 102, the upper receiver 4, a barrel 106, the magazine 8, and the lower receiver 10. For the pistol 100, the buffer tube 102 replaces the stock 2 and is secured to the lower receiver 10 by the stock mount 20. The buffer tube 102 may also include an arm brace (not shown). It will be appreciated that the barrel 106 of the pistol 100 is substantially similar to the barrel 2 of the firearm 1 detailed above. The pistol 100 functions in a similar manner to the firearm 1 detailed above.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A lower receiver for a firearm, the lower receiver comprising:

a body including a wall and defining:

a trigger well configured and dimensioned to receive a firing mechanism; and a magazine well extending from the trigger well, the magazine well configured and dimensioned to receive a magazine, wherein the wall separates the magazine well from the trigger well, the wall defining a threaded retention opening configured and dimensioned to threadably receive a magazine retention member for fixing a magazine within the magazine well.

2. The lower receiver according to claim 1, further comprising a mount disposed at a proximal portion of the trigger well.

3. The lower receiver according to claim 2, wherein the mount defines a tool passage aligned with the retention opening, the mount configured to secure a stock to the lower receiver such that the stock covers the tool passage.

4. The lower receiver according to claim 1, further comprising a firing mechanism disposed within the trigger well and configured to prevent access to a magazine retention member when disposed in the retention opening.

5. A firearm comprising:

a stock;

an upper receiver defining a chamber;

a barrel extending distally from the upper receiver;

a lower receiver pivotally coupled to the upper receiver, the lower receiver including:

a body defining a trigger well configured and dimensioned to receive a firing mechanism and a magazine well extending from the trigger well, the body including a wall separating the magazine well from the trigger well, the wall defining a threaded retention opening; and a mount positioned on a proximal wall defining the trigger well, the stock secured to the mount;

a magazine disposed within the magazine well of the lower receiver, a proximal wall of the magazine defining a retention hole; and a magazine retention member threaded through the retention opening and extending through the retention hole to fix the magazine within the magazine well of the lower receiver.

6. The firearm according to claim 5, wherein the retention hole of the magazine is threaded and the magazine retention member is a screw which is threadable into the retention hole.

7. The firearm according to claim 5, further comprising a firing mechanism disposed within the trigger well of the lower receiver, the firing mechanism configured and dimensioned to prevent access to the magazine retention member.

8. The firearm according to claim 5, wherein the mount defines a tool passage aligned with the retention opening, the tool passage is configured to allow a tool to access the magazine retention member disposed within the retention opening.

9. The firearm according to claim 8, further comprising a firing mechanism disposed between the tool passage and the retention opening to prevent access to the magazine retention member when the firing mechanism is installed within the lower receiver.

10. The firearm according to claim 8, wherein the stock covers the tool passage when the stock is attached to the lower receiver.

11. A non-detachable magazine lower receiver for a firearm, the lower receiver comprising:

a body defining:

a trigger well configured and dimensioned to receive a firing mechanism; and a magazine well extending from the trigger well configured and dimensioned to receive a magazine, wherein a proximal wall defining the magazine well and a distal wall defining the trigger well cooperate to define a threaded retention opening that passes between the magazine well and the trigger well, the retention opening being configured and dimensioned to threadably receive a magazine retention member for fixing a magazine to the lower receiver.

12. The non-detachable magazine lower receiver according to claim 11, further comprising a firing mechanism disposed within the trigger well configured and dimensioned to prevent access to a magazine retention member disposed within the retention opening.

13. The non-detachable magazine lower receiver according to claim 11, further comprising a stock mount configured and dimensioned to attach a stock to the lower receiver, the stock mount defining a tool passage aligned with the retention opening, the tool passage configured to permit passage of a tool, wherein the tool passage is positioned to be covered when a stock is attached to the lower receiver.

* * * * *